United States Patent [19]

Oakes

[11] Patent Number: 4,655,953

[45] Date of Patent: Apr. 7, 1987

[54] DETERGENT BLEACH COMPOSITIONS

[75] Inventor: John Oakes, Winsford, Great Britain

[73] Assignee: Lever Brothers Company, New York, N.Y.

[21] Appl. No.: 678,320

[22] Filed: Dec. 5, 1984

[30] Foreign Application Priority Data

Dec. 6, 1983 [GB] United Kingdom ..... 8332486

[51] Int. Cl.[4] ..... C11D 3/39; C11D 3/08

[52] U.S. Cl. ..... 252/99; 252/95; 252/180.41; 252/186.41; 8/107

[58] Field of Search ..... 252/95, 99, 186.41; 8/107, 111

[56] References Cited

U.S. PATENT DOCUMENTS

| | | | |
|---|---|---|---|
| 3,156,654 | 11/1964 | Konecny et al. | 252/95 |
| 3,398,096 | 8/1968 | Das et al. | 252/95 |
| 3,532,634 | 10/1970 | Woods | 252/95 |
| 3,549,539 | 12/1970 | Mallows | 252/99 |
| 4,208,295 | 6/1980 | Sai et al. | 252/94 |
| 4,430,243 | 2/1984 | Bragg | 252/91 |

FOREIGN PATENT DOCUMENTS

| | | |
|---|---|---|
| 25608 | 3/1981 | European Pat. Off. . |
| 72166 | 2/1983 | European Pat. Off. . |
| 82563 | 6/1983 | European Pat. Off. . |
| 78209 | 7/1978 | Japan . |

OTHER PUBLICATIONS

Chalmers, L. "Domestic and Industrial Chemical Specialties", The Macmillan Co. (1966), pp. 35, 38.

*Primary Examiner*—Prince E. Willis

*Attorney, Agent, or Firm*—Milton L. Honig; James J. Farrell

[57] ABSTRACT

Detergent bleach compositions comprising a peroxide compound bleach, a manganese bleach catalyst and sodium sesquisilicate and/or sodium metasilicate, having a solution pH of from 9.5 to 13. The compositions show enhanced bleaching effect and are suitable for the laundering of fabrics at lower temperatures of between 20° and 60° C.

5 Claims, No Drawings

DETERGENT BLEACH COMPOSITIONS

This invention relates to detergent bleach compositions comprising a peroxide compound bleach and a manganese bleach catalyst suitable for the bleaching and cleaning of fabrics at lower temperatures. The peroxide compound bleach used herein includes hydrogen peroxide and hydrogen peroxide adducts, e.g. inorganic persalts which liberate hydrogen peroxide in aqueous solutions such as the water-soluble perborates, percarbonates, perphosphates, persilicates and the like.

In European Patent Application No. 0082563 there are described the outstanding properties of manganese with respect to consistently enhancing the bleach performance of peroxide compounds at substantially all washing temperatures, especially at lower temperatures, if used in combination with a carbonate compound which delivers carbonate ions ($CO^{3}2-$) in aqueous media.

It has now been found that the activation of peroxide compound bleaches by manganese, so as to render them usable for bleaching at lower temperatures, e.g. from 20° to 60° C., can be enhanced if used in conjunction with sodium sesquisilicate or sodium metasilicate containing detergent compositions having an alkaline pH of from 9.5 to about 13.0.

Sodium sesquisilicate is sodium silicate having the formula $Na_6Si_2O_7$.

Sodium metasilicate is sodium silicate having the formula $Na_2SiO_3$. It can be used in either its anhydrous form or as its pentahydrate.

Sodium metasilicate and sodium sesquisilicate can be used as high alkaline builder in industrial laundry detergent compositions and machine dishwashing powders, which normally have a wash liquor pH of above 10.5, i.e. about 11 to 13, as distinct from household laundry detergents, which normally have lower wash liquor pHs of about 9.5–10.5.

The present invention is therefore particularly applicable to industrial laundry detergent compositions as well as to machine dishwashing powders for giving an improved bleaching performance without the use of chlorine bleaches which are currently used in the practice of machine dishwashing and industrial textile laundering, but is not limited thereto.

Accordingly the invention provides an alkaline built detergent bleach composition comprising a peroxide compound bleach and a manganese compound which delivers manganese (II) ions in aqueous solution, characterized in that it comprises sodium sequisilicate and/or sodium metasilicate and has a solution pH of from 9.5 to 13, preferably from 10.5 to 13.

By "solution pH" is meant here the pH of the composition under use conditions measured at 5 g/l.

The manganese used according to the present invention can be derived from any manganese (II) salt, such as manganous sulphate and manganous chloride, or any other manganese compound which delivers manganese (II) ions in aqueous solution.

The optimum levels of manganese (II) ions—$Mn^{2+}$—in the wash/bleach solution are dependent upon the formulation in which the manganese as bleach catalyst is applied. In terms of parts per million (ppm) of manganese (II) ions in the wash/bleach solution a suitable range will generally be from 0.1 to 25 ppm, preferably from 0.5–10 ppm.

These correspond roughly to a manganese (II) metal content in a bleach or detergent composition of about 0.002–1.5% by weight, preferably from about 0.01–0.5% by weight of the composition.

The level of peroxide compound bleach, such as sodium perborate, sodium percarbonate, sodium persilicate, sodium perpyrophosphate and urea peroxide, which can be used in the present invention will normally be in the range of about 5 to 50%, preferably from 10 to 35% by weight of the composition.

The sodium sesquisilicate and/or sodium metasilicate may be used as the sole builders in the composition of the invention, or they can be used in admixture with other principal or non-principal builders, either inorganic or organic in nature.

Examples of suitable inorganic alkaline detergency builders are water-soluble alkalimetal phosphates, polyphosphates, borates, and also carbonates. Specific examples of such salts are sodium and potassium triphosphates, pyrophosphates, orthophosphates, hexametaphosphates, tetraborates, and carbonates.

Examples of suitable organic alkaline detergency builder salts are: (1) water-soluble amino polycarboxylates, e.g. sodium and potassium ethylenediaminetetraacetates, nitrilotriacetates and N-(2-hydroxyethyl)nitrilodiacetates; (2) water-soluble salts of phytic acid, e.g. sodium and potassium phytates (see U.S. Pat. No. 2 379 942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid.

Other examples include the alkali metal salts of ethane-2-carboxy-1,1-diphosphonic acid, hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of poly-carboxylate polymers and copolymers as described in U.S. Pat. No. 3 308 067.

In addition, polycarboxylate builders can be used satisfactorily, including water-soluble salts of mellitic acid, citric acid, and carboxymethyloxysuccinic acid and salts of polymers of itaconic acid and maleic acid.

Certain zeolites or aluminosilicates can also be used. One such aluminosilicate which is useful in the compositions of the invention is an amorphous water-insoluble hydrated compound of the formula $Na_x(_yAlO_2.SiO_2)$, wherein x is a number from 1.0 to 1.2 and y is 1, said amorphous material being further characterized by an $Mg^{++}$ exchange capacity of from about 50 mg eq. $CaCO_3$/g to about 150 mg eq. $CaCO_3$/g and a particle diameter of from about 0.01 micron to about 5 microns. This ion exchanger builder is more fully described in British Pat. No. 1 470 250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium ion exchange rate on an anhydrous basis of at least about 2 grains/gallon/minute/gram. These synthetic aluminosilicates are more fully described in British Pat. No. 1 429 143.

Consequently, the total amount of sodium sesquisilicate and/or sodium metasilicate in the composition of the invention can be varied as desired for providing the required alkalinity and builder capacity of the composition with or without the presence of other builders.

In practice the composition of the invention may comprise from about 2% by weight of the sodium sesquisilicate and/or sodium metasilicate, which may increase up to about 60% by weight in the case of industrial laundry detergents. In household laundry detergents the amount of sodium sesquisilicate and/or metasilicate employed will be in the range of between 2% and 15% by weight, preferably from 4 to 12% by weight.

Any manganese (II) salt can in principle be employed, such as for example manganous sulphate ($Mn.SO_4$), either in its anhydrous form or as hydrated salt, manganous chloride ($MnCl_2$), anhydrous or hydrated, and the like.

The detergent bleach composition of the invention usually contains a surface active agent, generally in an amount of from about 1% to 50% by weight, preferably from 5–30% by weight. The surface active agent can be anionic, nonionic, zwitterionic or cationic in nature or mixtures of such agents.

Preferred anionic non-soap surfactants are water-soluble salts of alkylbenzene sulphonate, alkyl sulphate, alkylpolyethoxyether sulphate, paraffin sulphonate, alpha-olefin sulphonate, alpha-sulfocarboxylates and their esters, alkylglycerylethersulphonate, fatty acid monoglyceride-sulphates and -sulphonates, alkylphenolpolyethoxy ethersulphate, 2-acyloxy-alkane-1-sulphonate, and beta-alkyloxy alkanesulphonate. Soaps are also preferred anionic surfactants.

Especially preferred are alkylbenzenesulphonates with about 9 to about 15 carbon atoms in a linear or branched alkyl chain, more especially about 11 to about 13 carbon atoms; alkylsulphates with about 8 to about 22 carbon atoms in the alkyl chain, more especially from about 12 to about 18 carbon atoms; alkylpolyethoxy ethersulphates with about 10 to about 18 carbon atoms in the alkyl chain and an average of about 1 to about 12 —$CH_2CH_2O$—groups per molecule, especially about 10 to about 16 carbon atoms in the alkyl chain and an average of about 1 to about 6 —$CH_2CH_2O$—groups per molecule; linear paraffin sulphonates with about 8 to about 24 carbon atoms, more especially from about 14 to about 18 carbon atoms and alpha-olefin sulphonates with about 10 to about 24 carbon atoms, more especially about 14 to about 16 carbon atoms; and soaps having from 8 to 24, especially 12 to 18 carbon atoms.

Water-solubility can be achieved by using alkali metal, ammonium, or alkanolamine cations; sodium is preferred. Magnesium and calcium may be preferred cations under certain circumstances.

Preferred nonionic surfactants are water-soluble compounds produced by the condensation of ethylene oxide with a hydrophobic compound such as an alcohol, alkyl phenol, polypropoxy glycol, or polypropoxy ethylene diamine.

Especially preferred polyethoxy alcohols are the condensation product of 1 to 30 moles of ethylene oxide with 1 mol of branched or straight chain, primary or secondary aliphatic alcohol having from about 8 to about 22 carbon atoms; more especially 1 to 6 moles of ethylene oxide condensed with 1 mol of straight or branched chain, primarily or secondary aliphatic alcohol having from about 10 to about 16 carbon atoms; certain species of poly-ethoxy alcohol are commercially available under the trade-names of "Neodol" ®, "Synperonic" ® and "Tergitol" ®.

Preferred zwitterionic surfactants are water-soluble derivatives of aliphatic quaternary ammonium, phosphonium and sulphonium cationic compounds in which the aliphatic moieties can be straight or branched, and wherein one of the aliphatic substituents contains from about 8 to 18 carbon atoms and one contains an anionic water-solubilizing group, especially alkyldimethyl-propanesulphonates and alkyldimethyl-ammoniohydroxypropane-sulphonates wherein the alkyl group in both types contains from about 1 to 18 carbon atoms.

Preferred cationic surface active agents include the quaternary ammonium compounds, e.g. cetyltrimethylammonium-bromide or -chloride and distearyldimethylammonium-bromide or -chloride, and the fatty alkyl amines.

A typical listing of the classes and species of surfactants useful in this invention appear in the books "Surface Active Agents", Vol. I, by Schwartz & Perry (Interscience 1949) and "Surface Active Agents", Vol. II by Schwarz, Perry and Berch (Interscience 1958), the disclosures of which are incorporated herein by reference. The listing, and the foregoing recitation of specific surfactant compounds and mixtures which can be used in the specific surfactant compounds and mixtures which can be used in the instant compositions, are representative but are not intended to be limiting.

Detergent bleach compositions for use in machine dishwashing normally contain only very low levels of low- to non-foaming nonionic surfactants, i.e. in the order of 1 to 2%.

The invention however is primarily directed to household or industrial laundry detergent compositions and will be further illustrated with respect thereto.

In addition thereto the compositions of the invention may contain any of the conventional components and/or adjuncts usable in fabric washing compositions.

As such can be named, for instance, other conventional or non-conventional detergency builders, inorganic or organic, which can be used together with the builder mixture of the invention up to a total builder level of about 80% by weight.

Examples of suitable other inorganic builders are triphosphates, borates, other silicates and carbonates. Specific examples of such salts are sodium and potassium tetraborates, neutral silicates and sodium carbonates. Examples of organic builders are alkylmalonates, alkylsuccinates, nitrilotriacetates and carboxymethyloxymalonates.

Other components/adjuncts commonly used in detergent compositions are for example soil-suspending agents such as water-soluble salts of carboxymethylcellulose, carboxyhydroxymethylcellulose, copolymers of maleic anhydride and vinyl ethers, and polyethylene glycols having a molecular weight of about 400 to 10.000. These can be used at levels of about 0.5% to about 10% by weight. Dyes, pigments, optical brighteners, perfumes, anti-caking agents, suds control agents, enzymes and fillers can also be added in varying minor amounts as desired. Other peroxide activators, such as tetraacetyl ethylene diamine and other peracid precursors, may also be added but are not normally required.

The detergent compositions of the invention are preferbly presented in free-flowing particulate, e.g. powdered or granular form, and can be produced by any of the techniques commonly employed in the manufacture of such detergent compositions, for example by a dry-mixing process or by slurry-making and spray-drying processes to form a detergent base powder to which the heat-sensitive ingredients, including the peroxide compound and optionally some other ingredients as desired, are added. It is preferred that the process used to form the compositions should result in a product having a moisture content of not more than about 12%, more preferably from about 4% to about 10% by weight. The manganese compound may be added to the compositions as part of the aqueous slurry, which is then dried to a particulate detergent powder, or preferably as a dry substance mixed in with the base powder.

EXAMPLE I

The following particulate detergent compositions were prepared with manganese (II) as manganous sulphate added at various levels:

| Composition (% by weight) | I | Ia |
|---|---|---|
| Sodium $C_{12}$ alkylbenzene-sulphonate | 15.0 | 15.0 |
| Sodium metasilicate, anhydrous | 4.0 | 4.0 |
| Sodium perborate tetrahydrate | 25.0 | 25.0 |
| Manganous sulphate | + | – |
| Sodium sulphate + water up to 100% | | |
| pH of product at 5 g/l solution 10.4 | | |

These compositions were tested at a dosage of 5 g/l in a 30 minute isothermal wash at 40° C. in 24° H water. Composition Ia did not contain manganese and was used as control.

The bleaching effects obtained on tea-stained test cloths measured as ΔR (reflectance) were as follows:

TABLE A

| $[Mn^{2+}]$ ppm in solution | $[Mn^{2+}]$ % in product | ΔR |
|---|---|---|
| 0.0 | 0.0 | 3.61 |
| 0.5 | 0.01 | 10.91 |
| 0.6 | 0.012 | 11.62 |
| 0.75 | 0.015 | 7.78 |
| 0.9 | 0.018 | 9.95 |
| 1.0 | 0.02 | 7.48 |

EXAMPLE II

The following particulate detergent composition was prepared with manganese (II) as manganous sulphate added at various levels:

| Composition | % by weight |
|---|---|
| Sodium $C_{12}$—alkyl benzene sulphonate | 15.0 |
| Sodium metasilicate | 20.0 |
| Sodium perborate tetrahydrate | 25.0 |
| Manganous sulphate | + |
| Sodium sulphate + water up to 100%. | |
| pH of product at 5 g/l solution: 10.9 | |

These compositions were tested at a dosage of 5 g/l in a 30 minutes' isothermal wash at 40° C. in demineralized water.

The bleaching effects obtained on tea-stained test cloths, measured at ΔR (reflectance value) were as follows:

TABLE B

| $[Mn^{2+}]$ ppm in solution | $[Mn^{2+}]$ % by weight in product | ΔR |
|---|---|---|
| 0 | 0 | 10.0 |
| 0.1 | 0.02 | 15.0 |
| 0.5 | 0.010 | 22.0 |
| 1.0 | 0.02 | 23.0 |
| 2.0 | 0.04 | 24.0 |

EXAMPLE III

The following detergent composition was prepared, to which manganous sulphate was added at a level of 0.002% by weight as $Mn^{2+}$.

| Composition | % by weight |
|---|---|
| Sodium dodecyl benzene sulphonate | 15.0 |
| Sodium sesquisilicate | 8.0 |
| Sodium perborate | 25.0 |
| Manganous sulphate | + |
| Sodium sulphate + water up to 100% | |
| pH of product at 5 g/l solution: 10.9 | |

This composition was tested in the same manner as in Example II and the bleaching result on standard tea-stained test cloths, measured as reflectance (ΔR), was as follows:

TABLE C

| $[Mn^{2+}]$ ppm. in solution | $[Mn^{2+}]$ % by weight in product | ΔR |
|---|---|---|
| 0 | 0 | 16 |
| 1.0 | 0.02 | 23 |

EXAMPLE IV

The following two formulations were compared in a bleaching test carried out at a dosage of 5 g/l in a 30 minutes' isothermal wash in demineralized water of standard tea-stained test cloths.

| Composition | % by weight IV | % by weight (IV) |
|---|---|---|
| Sodium dodecyl benzene sulphonate | 15.0 | 15.0 |
| Sodium triphosphate | — | 25.0 |
| Sodium metasilicate | 25.0 | — |
| Sodium perborate | 25.0 | 25.0 |
| Manganous sulphate [as $Mn^{2+}$] | 0.04 | 0.04 |
| Sodium sulphate + water up to 100% | 11.0 | 11.0 |
| pH (5 g/l) made up to: | | |
| Reflectance value (ΔR) | 24.0 | 3.0 |

The superiority of Composition IV of the invention to Composition (IV) outside the invention is clear.

I claim:

1. Alkaline built laundry detergent bleach composition comprising:

(a) from 1 to 50% by weight of an anionic surface active agent;

(b) from 5 to 50% by weight of a peroxide compound bleach, which liberates hydrogen peroxide in aqueous solution;

(c) a manganese compound which delivers manganese (II) ions in aqueous solution in an amount from 0.002 to 1.5% by weight of manganese (II); and (d) from 2 to 60% by weight of sodium sesquisilicate and/or sodium metasilicate, said composition having a solution pH of from 9.5 to 13.

2. Detergent bleach composition according to claim 1, comprising from 0.01 to 0.5% by weight of manganese (II).

3. Detergent bleach composition according to claim 1, comprising from 4 to 12% by weight of said sodium sesquisilicate and/or sodium metasilicate.

4. Detergent bleach composition according to claim 1, having a solution pH of from 10.5 to 13.

5. Detergent bleach composition according to claim 1 further comprising from 1 to 50% by weight of a surface active agent selected from the group consisting of nonionic, zwitterionic and cationic detergents and mixtures thereof.

* * * * *